US006086222A

United States Patent [19]

Juba et al.

[11] Patent Number: 6,086,222

[45] **Date of Patent: *Jul. 11, 2000**

[54] PAIRED CASCADE EFFECT ICICLE LIGHT SETS

[75] Inventors: Hisashi Juba, Rye; Najeh Rahman, Monsey, both of N.Y.

[73] Assignee: Minami International, Inc., Yonkers, N.Y.

[ * ] Notice: This patent is subject to a terminal disclaimer.

[21] Appl. No.: 09/227,521

[22] Filed: Jan. 8, 1999

[51] Int. Cl.[7] ..... F21V 23/04

[52] U.S. Cl. ..... 362/251; 362/251; 362/252; 362/249; 362/227; 362/123; 362/806

[58] Field of Search ..... 362/251, 252, 362/249

[56] References Cited

U.S. PATENT DOCUMENTS 5,934,793 8/1999 Rahman ..... 362/249

5,975,717 11/1999 Rahman ..... 362/251

*Primary Examiner*—Sandra O'Shea
*Assistant Examiner*—Bertrand Zeade
*Attorney, Agent, or Firm*—Amster, Rothstein & Ebenstein

[57] ABSTRACT

A chaser or cascade-effect icicle light set includes a transversely extending common wire portion, and a plurality of transversely spaced, parallel light strings depending from the common wire portion. Each light string defines a plurality of lamp sockets physically disposed in a series. The lamp sockets of the plurality of light strings are organized into a plurality of series-wired sets corresponding to given points along the lengths of the light strings. All lamp sockets of a given set within a given light string being electrically disposed in series. The number of the lamp sockets in each light string is an exact multiple of the number of sets. Controls for actuating and deactivating the sets successively produce a cascade wherein each set of each light string flashes on and off in substantially horizontal unison as a set to provide a cascade-effect.

7 Claims, 2 Drawing Sheets

PAIRED CASCADE EFFECT ICICLE LIGHT SETS

BACKGROUND OF THE INVENTION

The present invention relates to a cascade effect icicle light set and, more particularly, to a pair thereof adapted for electrical interconnection.

It is known to provide an "icicle" light set wherein there is a transversely extending common wire means at an upper portion of the light set and a plurality of transversely extending spaced parallel light strings descending from the common wire means like icicles. Each icicle contains a plurality of lamp sockets, and the icicles may be of different lengths containing 1, 2, 3, 4, etc. lamp sockets or they may be a common length containing a like plurality of lamp sockets. The lamps in each icicle may be activated and deactivated as a unit, typically independently of the lamps in the other icicles. The visual impression created by the known icicle light sets is not entirely satisfactory as it does not adequately portray the visual effect of melting icicles. Inherent in the concept of a melting icicle is the dripping or downward movement of the water from the top of the icicle to the bottom of the icicle. Thus, the need remains for a chaser icicle light set which will allow the lamps in each light string to be activated and deactivated in a downwardly moving or "chaser" pattern.

Commonly owned U.S. patent application Ser. No. 08/992,988 discloses such a cascade effect icicle light set. The lamps in each icicle (i.e., light string) create the visual effect of descending melted water. The first (highest) lamp of each icicle will turn on and off as a unit, followed by the second lamp of each icicle as a unit, followed by the third lamp of each icicle as a unit, etc. The cascade effect icicle light set comprises a transversely extending common wire means, and a plurality of transversely spaced parallel light strings (i.e., icicles) depending from the common wire means. Each light string defines a plurality of lamp sockets physically disposed in a series, the lamp sockets of the plurality of light strings being organized into a plurality of sets corresponding to given points along the lengths of the light strings. Means are provided for activating and deactivating the sets successively to produce a cascade wherein each set of each light string flashes on and off substantially in horizontal unison as a set to provide a chaser icicle effect. Preferably, all lamp sockets of a given set within a given light string are electrically disposed in series (i.e., series-wired), and the number of lamp sockets in each light string is an exact whole integer multiple of the number of series-wired sets.

It is a common practice for "icicle" light sets to additionally include an assembly having an electrical plug for receiving power from a power supply via the plug and distributing the power to the plurality of transversely spaced parallel light strings of the light set (e.g., via a control unit). At least one of the light sets (and preferably all of the light sets save the last) includes an end connector for receiving the plug of another one of the light sets. Such an arrangement is, however, impossible in a pair of cascade effect icicle light sets, as described above, because the power supply made available by the control unit is less than the full power being applied to the control unit. Simply put, the control unit of the initial light set and the end connector thereof (for receiving the plug of the other light set) do not afford access to the full voltage being applied to the initial control unit. Thus the second light set would be taking power away from the first light set, with the result that the lamps of both light sets would burn less brightly (i.e., more dimly).

Accordingly, while an icicle light effect can be extended indefinitely—for example, about the periphery of a building—simply by interconnecting a plurality of icicle light sets, the same is not true for a "cascade effect" icicle light set. As the transversely extending common wire means is typically of very limited length in a cascade effect icicle light set, the need remains for a structure which is modified to permit multiple cascade effect light sets to be electrically interconnected. Preferably, each of the icicle effect light sets thus electrically interconnected could be controlled by its control unit separately and independently from each adjacent light set.

Accordingly, it is an object of the present invention to provide a pair of cascade effect icicle light sets adapted for electrical interconnection.

Another object is to provide such a pair of light sets wherein, in one embodiment, the control unit of each light set is capable of separate and independent control.

A further object is to provide such a pair of light sets wherein full power is made available to the plug of each light set.

It is another object of the present invention to provide such a pair of light sets wherein, in different embodiments, the plug of the second light set may be plugged into either the control unit or an end connector of the first light set.

SUMMARY OF THE INVENTION

It has been found that the above and related objects of the present invention are obtained in a pair of cascade effect icicle light sets. The cascade effect icicle light set comprises a transversely extending common wire means, and a plurality of transversely spaced parallel light strings depending from the common wire means. Each light string defines a plurality of lamp sockets physically disposed in a series, the lamp sockets of the plurality of light strings being organized into a plurality of series-wired sets corresponding to given points along the lengths of the light strings. Means are provided for activating and deactivating the sets successively to produce a cascade wherein each set of each light string flashes on and off substantially in horizontal unison as a set to provide a chaser icicle effect. Preferably, all lamp sockets of a given set within a given light string are electrically disposed in series, and the number of lamp sockets in each light string is an exact whole integer multiple of the number of sets.

According to the present invention, a pair of cascade effect icicle light sets, as described above, are adapted for electrical interconnection. Each light set further comprises an assembly having an electrical plug and a control unit for receiving power from a power supply via the plug and distributing the power to the plurality of transversely spaced parallel light strings of the light set. At least one of the light sets includes an end connector for receiving the plug of the other of the light sets and a pair of electrical wires connecting the end connector functionally directly to the plug of the one light set.

In a preferred embodiment, the pair of electrical wires electrically connects the end connector of one light set functionally directly to the plug of that light set via the control unit of that light set.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
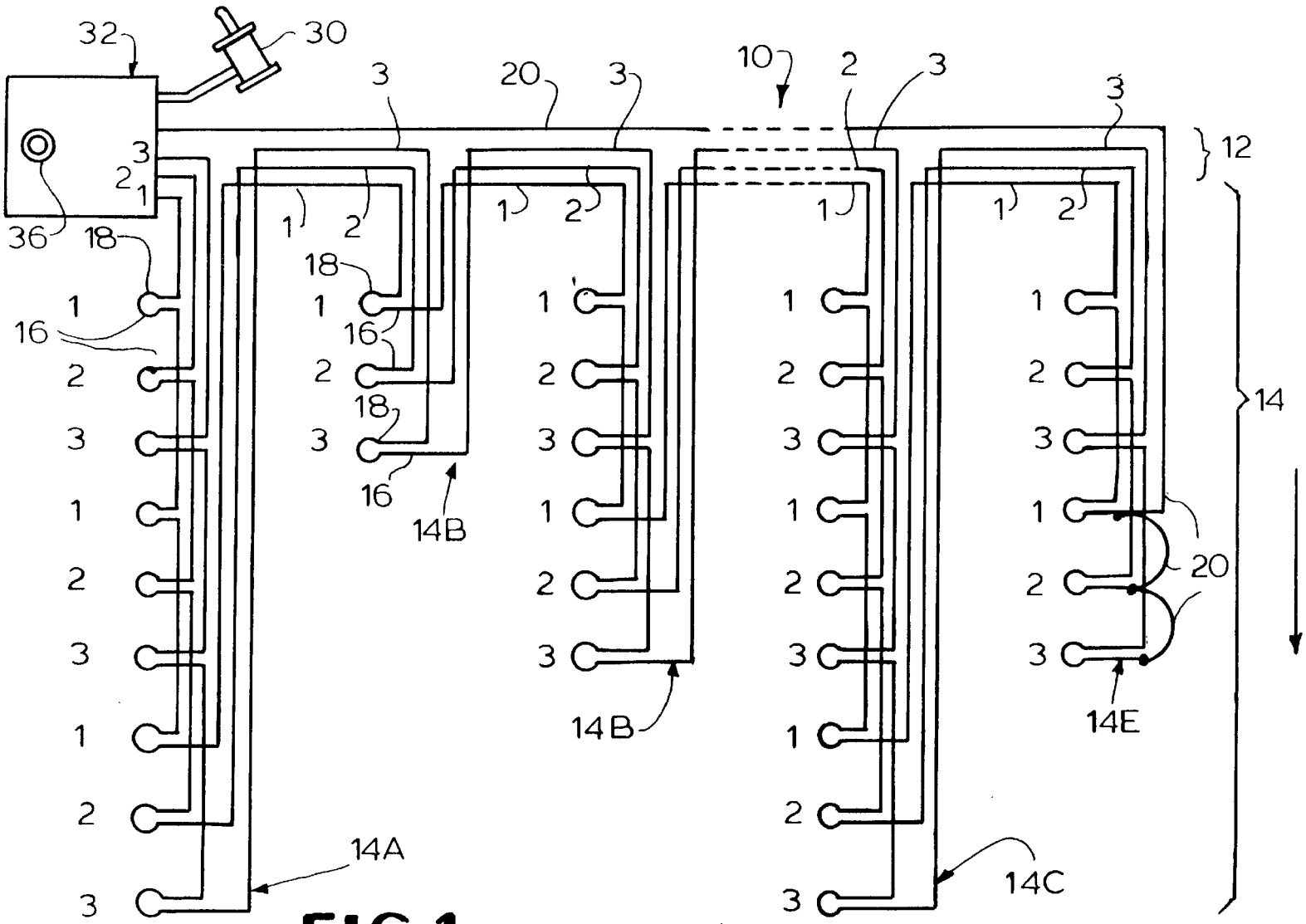
FIG. 1 is a fragmentary circuit diagram of a single cascade effect icicle light set identified as prior art to the present invention, the physical layout of the components thereof also being illustrated.

Referring now to the drawing, and in particular to FIG. 1 thereof, therein illustrated is a circuit diagram of a cascade icicle light set designated as prior art, generally designated by the reference numeral 10, the physical layout of the components thereof also being illustrated. Depending upon the available voltage and the power consumption of the lamps used therein, the light set would typically have a 105, 140, 150 or some other quantity of icicle lights in motion. Preferred wiring is "22AWG, CXTW, 105C, UV RATED, VW-1."

The light set 10 comprises a transversely extending common wire means, generally designated 12, and a plurality of transversely spaced parallel light strings, generally designated 14. Each light string 14 defines a plurality of lamp sockets 16, each containing a lamp 18. It will be appreciated that the lamp sockets 16 of a given light string 14 are physically disposed in a series, but that they are not electrically disposed in series.

As illustrated, light string 14A has 9 lamps, 14B has 3 lamps, 14C has 6 lamps, 14D has 9 lamps, and 14E has 6 lamps. Although five light strings 14A–14E are shown, there may be fewer or more light strings in any given light set. As will also be clear to those skilled in the art, the number of lamps in each light string 14 may be varied from that illustrated, so long as the constraint noted below is observed.

The lamp sockets 16 of the various light strings 14 are organized into a plurality of series-wired sets 1, 2, 3 corresponding to given points along the lengths of the light strings and served, respectively, by active wires 1, 2, 3. As illustrated, there are three series-wired sets: set 1, set 2, and set 3. Thus in light string 14A, the active wire 1 is in electrical communication with each of the three lamp sockets 16 of set 1, the active wire 2 is in electrical communication with each of the three sockets of set 2, and the active wire of set 3 is in electrical communication with each of the three sockets of light set 3. Turning now to the light string 14B, the active wire of set 1 is in electrical communication with the first lamp socket 16 (set 1), the active wire 2 is in electrical communication with the second lamp socket 16 (set 2), and the active wire 3 is in electrical communication with the third lamp socket (set 3). The same type of analysis applies to light strings 14B–14E. Where there are 4 or more sets, additional active wires (not shown) to accommodate the extra sets are provided.

A control means, generally designated 32, is in electrical communication with a plug 30 inserted into a power supply (not shown). The control means 32 is preferably a conventional integrated circuit control which activates and deactivates the sets 1, 2, 3 successively to produce a cascade or waterfall effect wherein the lamps 18 of each set 1, 2, 3 of each light string 14A–14E flash on and off substantially in horizontal unison as a set to provide a cascade effect. A preferred control means 32 is provided with means (such as rotatable knob 36) for varying the speed with which the lamps 18 of the various sets 1, 2, 3 in all light strings 12 are activated and deactivated in series, and preferably also for activating all the lamps 18 of all the sets 1, 2, 3 in all light strings 12 simultaneously. The control means 32 additionally receives the common ground wire 20 for the several sets (extending from the last light string 14 (here, 14E)). Thus, light string 14B has only one lamp 18 of each set, light strings 14C and 14E have two lamps of each set, and light strings of 14A and 14D have three lamps of each set. When the control means 32 energizes the active wires of sets 1, 2, and 3 successively, the topmost lamp 18 of each light string is briefly illuminated, 14 (i.e., set 1) followed by the second lamp 18 of each light string 14 (i.e., set 2), and finally followed by the third lamp 18 of each light string 14 (i.e., set 3). This produces the cascade effect in which the bulbs of the various sets are briefly lit in relatively swift succession.

In the case of each of light strings 14A and 14C–14E, there are multiple lamps 18 which will flicker on and off as each set 1, 2, 3 is in turn activated and deactivated by control means 32 because each of the lamp sockets 16 of a given set 1, 2, 3 within a given light string 14 is electrically disposed in series so the set is activated and deactivated as a unit.. However, this does not destroy the cascade icicle effect because, at least for preferred cascade speeds, easily determined by adjustment of the knob 36 of control means 32, the illusion will be maintained. The illusion is modified in that, instead of an icicle dripping downwardly only from the top thereof, it will drip downwardly from various points along its lengths. The modified illusion created by a light string containing a greater number of lamps 18 than the number of sets may be considered to be more impressive and effective than that created by a shorter light string. Thus, the best cascade effect is a combination of two factors: first, the lamps 18 of each series-wired set 1, 2, 3 in each light string 14 flashing in horizontal unison across the plurality of light strings 14 in the light set 10, and, second, the number of lamps 18 of each light string 14 exceeding the number of sets 1, 2, 3 and flashing as successive series-wired sets.

The number of lamp sockets 16 in each light string 14 is preferably an exact whole integer multiple of the number of series-wired sets—e.g., the multiplier is 1, 2, 3, etc. Thus, the number of lamp sockets 16 in light string 14B is three (equivalent to the three sets shown), the number of lamp sockets 16 in each of light strings 14C and 14E is six (twice the number of sets), and the number of lamp sockets 16 in each of light strings 14A and 14D is nine (three times the number of sets). The use of the number of lamps sockets in each light string being an exact whole integer multiple of the number of sets insures that the cascading effect is most pronounced since the first lamp in each light string will be part of series-wired set 1, the second will be part of series-wired set 2, and so forth. Consequently, when each series-wired set 1, 2, 3, is activated seriatim, the first lamp in each light string will become activated simultaneously. Also, the use of the same number of lamps in each series-wired set results in each lamp receiving the same voltage differential and burning with equal brightness. If there were more lamp sockets in a first set than in another set, the lamps 18 of the first set would not burn as brightly as the lamps 18 of the other set.

If the number of lamp sockets 16 in each light string 14 is not an exact whole integer multiple of the number of series-wired sets, it is still important that the first lamp of each light set be from set 1, the second lamp in each light string be from set 2, etc. This insures that the various lights of the various light strings will go on and off in substantially horizontal unison as a set to provide the chaser icicle effect.

The various wires connecting the control means 32 to the first light string 14A, the portions of the wires connecting, (i.e., intermediate) the light strings 14A–14E, and a major portion of the ground wire 20 (the portion being that illustrated as horizontal) are preferably twisted together or otherwise connected together at various points by connectors to form the transversely extending common wire means 12. The several wires 1, 2, 3 and 20 of the common wire means 12 may, alternatively or in addition thereto, be secured to a transversely extending support (not shown) affording greater rigidity than that provided by the common wire means 12 itself.

Figure 2:
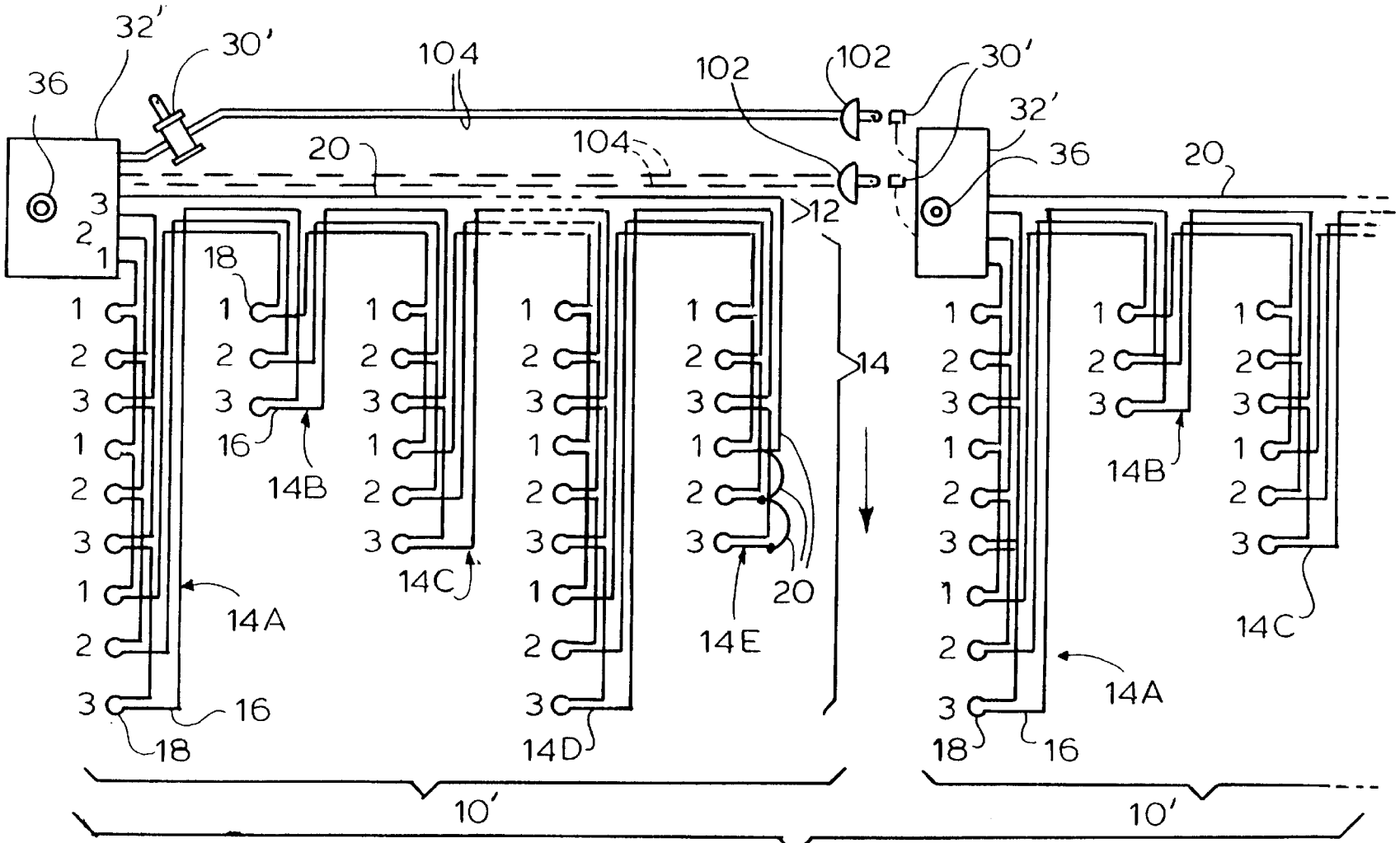
FIG. 2 is a fragmentary circuit diagram of a pair of electrically interconnected cascade effect icicle light sets.

Referring now to FIG. 2, therein illustrated are a pair of cascade effect icicle light sets adapted for electrical interconnection, generally designated 100. Each cascade effect icicle light set 10' is substantially as described hereinabove, the control unit 32' thereof being adapted to receive power from a power supply via a plug 30' and distributing the power to the plurality of transversely spaced parallel light strings 14 of the light set 10'.

The light set pair 100 of the present invention has at least one of the light sets 10' (and preferably all of the light sets 10' or at least all of the light sets 10' save the last one) include an end connector 102 for receiving the plug 30' of the other of the light sets 10' and a pair of electrical wires 104 electrically connecting the end connector 102 functionally directly to the plug 30' of at least one light set 10'.

The pair of electrical wires 104 may electrically connect the end connector 102 of the first light set 10' functionally directly to the plug 30' of the first light set 10' in two alternative ways: directly or via the control unit 32' of the light set 10'. Thus, in the direct embodiment illustrated in solid line in FIG. 2, each terminal of the plug 30' may provide not only a conventional output to the control unit 32', but also to the end connector 102 via a pair of electrical wires 104 which electrically connect the end connector 102 functionally directly to the plug 30'.

Alternatively, in the indirect embodiment illustrated in dotted line in FIG. 2, the electrical wires 104 may extend from the end connector 102 functionally directly to the plug 30' via the control unit 32' of that light set. The plug 30' is connected to the control unit 32' and the control unit 32' has, in addition to output terminals for the various series-wired sets 1, 2, 3 (each of which receives only an aliquot of the full power) a pair of output terminals (which receive full power) connected to the end connector 102 by the wires 104.

It will be appreciated that the first embodiment (illustrated in solid line in FIG. 2) and the second embodiment (illustrated in phantom line in FIG. 2) are equivalent in that each assures full power being delivered to the electrical plug 30' of the next light set. The difference between the two embodiments resides in the physical technique used to deliver that full power to the end connector 102.

As used herein, the term "functionally directly" refers to the electrical connection between two elements (whether they be the plug and an end connector or the plug and an end connector via the control unit).

It will be appreciated that each of the light sets 10' includes a control unit 32' and that these control units 32' may or may not function in unison. Thus when the control units 32' function in unison, the first bulb of each light string of each light set 10' will go on and off in unison, followed by the second bulb of each light string of each light set 10', etc. When the control units do not function in unison, the first bulbs of each light string of the first light set 10' may flash on and off at different times than the first bulbs of each light string of the second light set 10'. Theoretically the control units 32' will operate in unison since they are powered by a common power supply.

In summary, the present invention provides a cascade effect icicle lamp set wherein the lamps in each icicle (light string) create the visual effect of descending melted water because the first (highest) lamp of each icicle will turn on and off as a unit, followed by the second lamp of each icicle as a unit, followed by the third lamp of each icicle as a unit, etc.

Thus, the present invention provides a pair of cascade effect icicle light sets adapted for electrical interconnection, with each light set being independently controlled according to its own control unit. The full power is made available to the plug of each light set, and the plug of the second light set may be plugged into either the control unit or an end connector of the first light set.

Now that the present invention has been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A pair of cascade effect icicle light sets adapted for electrical interconnection; each said light set comprising:

(A) a transversely extending common wire means;

(B) a plurality of transversely spaced parallel light strings depending from said common wire means, each light string defining a plurality of lamp sockets physically disposed in a series, said lamp sockets of said plurality of light strings being organized into a plurality of series-wired sets corresponding to given points along the lengths of said light strings;

(C) means of activating and deactivating said series-wired sets successively to produce a cascade wherein each said set of each said light string flashes on and off substantially in horizontal unison as a set to provide a cascade effect; and (D) an assembly having an electrical plug and a control unit for receiving power from a power supply via said plug and distributing the power to said plurality of transversely spaced parallel light strings of said light set;

at least one of said light sets including an end connector for receiving the plug of the other of said light sets, and a pair of electrical wires electrically connecting said end connector functionally directly to said plug of said one light set.

2. The pair of light sets of claim 1 wherein said pair of electrical wires electrically connects said end connecter of said one light set functionally directly to said plug of said one light set via said control unit of said one light set.

3. The light set of claim 1 wherein all lamp sockets of a given set within a given light string are electrically disposed in series.

4. The light set of claim 1 wherein the number of said lamp sockets in each said light string is an exact whole integer multiple of the number of series-wired sets.

5. A pair of light sets adapted for electrical interconnection;

each said light set including a plurality of transversely spaced parallel light strings, and an assembly having an electrical plug and a control unit for receiving power from a power supply via said plug and distributing the power to a plurality of transversely spaced parallel light strings of said light set; and at least one of said light sets including an end connector for receiving the plug of the other of said light sets, and a pair of electrical wires electrically connecting said end connector functionally directly to said plug of said one light set.

6. The pair of light sets of claim 5 wherein said pair of electrical wires electrically connects said end connecter of said one light set functionally directly to said plug of said one light set via said control unit of said one light set.

7. The pair of light sets of claim 5, wherein each light set is a cascade effect light set comprising:

(A) a transversely extending common wire means;

(B) a plurality of transversely spaced parallel light strings depending from said common wire means, each light string defining a plurality of lamp sockets physically disposed in a series, said lamp sockets of said plurality of light strings being organized into a plurality of series-wired sets corresponding to given points along the lengths of said light strings, all lamp sockets of a given series-wired set within a given light string being electrically disposed in series, the number of said lamp sockets in each said light string being an exact whole integer multiple of the number of series-wired sets.

* * * * *

US006086222C1

(12) EX PARTE REEXAMINATION CERTIFICATE (5291st)

United States Patent
Juba et al.

(10) Number: US 6,086,222 C1
(45) Certificate Issued: Mar. 7, 2006

(54) PAIRED CASCADE EFFECT ICICLE LIGHT SETS

(75) Inventors: Hisashi Juba, Rye, NY (US); Najeh Rahman, Monsey, NY (US)

(73) Assignee: Minami International Corporation, Yonkers, NY (US)

Reexamination Request:
No. 90/005,976, Apr. 6, 2001

Reexamination Certificate for:

| | |
|---|---|
| Patent No.: | **6,086,222** |
| Issued: | **Jul. 11, 2000** |
| Appl. No.: | **09/227,521** |
| Filed: | **Jan. 8, 1999** |

(51) Int. Cl.
*F21V 23/04* (2006.01)

(52) U.S. Cl. ..... 362/251; 362/252; 362/249; 362/227; 362/123; 362/806

(58) Field of Classification Search ..... 362/251, 362/252, 249, 227, 806; 315/185 R, 185 S, 315/210, 186, 187, 188, 189, 190, 191, 192, 315/193
See application file for complete search history.

(56) References Cited

U.S. PATENT DOCUMENTS

| | | | |
|---|---|---|---|
| 1,728,938 | A | 9/1929 | Kirschtein |
| 2,795,768 | A | 6/1957 | Duckworth et al. |
| 3,723,723 | A | 3/1973 | Lerner |
| 4,965,701 | A | 10/1990 | Voland |
| 5,150,964 | A | 9/1992 | Tsui |
| 5,559,681 | A | 9/1996 | Duarte |
| 5,645,342 | A | 7/1997 | Chang |
| 5,667,295 | A | 9/1997 | Tsui |
| 5,747,940 | A | 5/1998 | Openiano |
| 5,816,849 | A | 10/1998 | Schmidt |
| 5,828,183 | A | 10/1998 | Wang et al. |
| 5,834,901 | A | 11/1998 | Shen |
| 5,860,731 | A | 1/1999 | Martinez |
| 5,988,831 | A | 11/1999 | Pan |
| 6,033,088 | A | 3/2000 | Contigiani |
| 6,042,418 | A | 3/2000 | Cummings |

*Primary Examiner*—John Anthony Ward

(57) ABSTRACT

A chaser or cascade-effect icicle light set includes a transversely extending common wire portion, and a plurality of transversely spaced, parallel light strings depending from the common wire portion. Each light string defines a plurality of lamp sockets physically disposed in a series. The lamp sockets of the plurality of light strings are organized into a plurality of series-wired sets corresponding to given points along the lengths of the light strings. All lamp sockets of a given set within a given light string being electrically disposed in series. The number of the lamp sockets in each light string is an exact multiple of the number of sets. Controls for actuating and deactivating the sets successively produce a cascade wherein each set of each light string flashes on and off in substantially horizontal unison as a set to provide a cascade-effect.

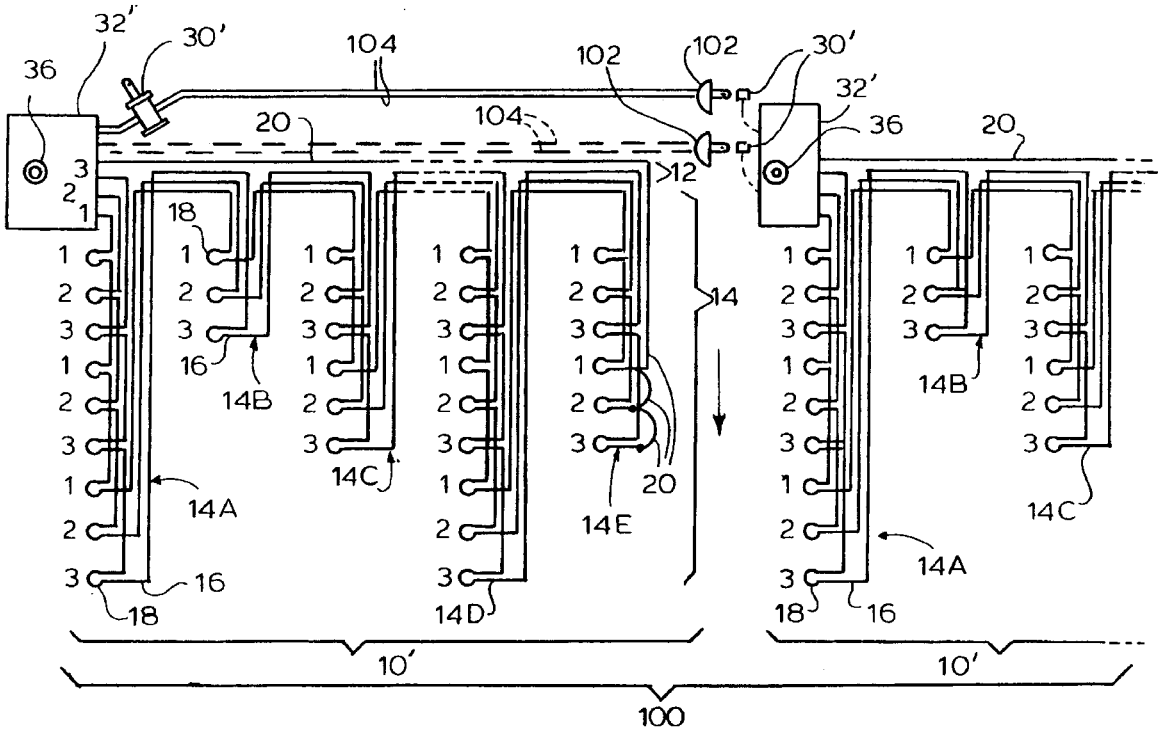

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

Claims 5 and 6 are cancelled.

Claim 7 is determined to be patentable as amended.

New claim 8 is added and determined to be patentable.

7. [The pair of light sets of claim 5,] *A pair of icicle light sets adapted for electrical interconnection:*

*each said icicle light set including a transversely extending common wire means, a plurality of transversely spaced parallel light strings depending from said common wire means, and an assembly having an electrical plug and a control unit for receiving power from a power supply via said plug and distributing the power*

*to a plurality of transversely spaced parallel light strings of said light set, each light string defining a plurality of lamp sockets physically disposed in a series said lamp sockets of said plurality of light strings being organized into a plurality of series-wired sets, all lamp sockets of a given series-wired set within a given light string electrically disposed in series; and*

*at least one of said icicle light sets including an end connector for receiving the plug of the other of the icicle light sets, and a pair of electrical wires electrically connecting said end connector functionally directly to the plug of said one icicle light set,* wherein each light set is a cascade effect light set comprising:

(A) [a] *said* transversely extending common wire means; *and*

(B) [a] *said* plurality of transversely spaced parallel light strings depending from said common wire means, each light string defining a plurality of lamp sockets physically disposed in a series, said lamp sockets of said plurality of light strings being organized into a plurality of series-wired sets corresponding to given points along the lengths of said light strings, all lamp sockets of a given series-wired set within a given light string being electrically disposed in series, the number of said lamp sockets in each said light string being an exact whole integer multiple of the number of series-wired sets.

*8. The pair of light sets of claim 5 wherein the number of said lamp sockets in each said light string is an exact whole integer multiple of the number of series-wired sets.*

* * * * *